US007632036B2

(12) United States Patent
Dupuis

(10) Patent No.: US 7,632,036 B2
(45) Date of Patent: Dec. 15, 2009

(54) NOTCHED PAVING STONE UNIT AND PAVED ASSEMBLIES FABRICATED THEREWITH

(75) Inventor: Bruno Dupuis, Acton Vale (CA)

(73) Assignee: Rocvale Produits De Beton Inc., Acton Vale (CA)

( * ) Notice: Subject to any disclaimer, the term of this patent is extended or adjusted under 35 U.S.C. 154(b) by 0 days.

(21) Appl. No.: 11/779,479

(22) Filed: Jul. 18, 2007

(65) Prior Publication Data

US 2008/0025793 A1 Jan. 31, 2008

Related U.S. Application Data

(60) Provisional application No. 60/820,273, filed on Jul. 25, 2006.

(51) Int. Cl.
*E01C 5/00* (2006.01)
*E01C 5/06* (2006.01)

(52) U.S. Cl. ..... 404/34; 404/35; 404/36

(58) Field of Classification Search ..... 404/17, 404/28–30, 34–42; 52/596, 604; D25/113
See application file for complete search history.

(56) References Cited

U.S. PATENT DOCUMENTS

| | | | | | |
|---|---|---|---|---|---|
| 496,099 | A * | 4/1893 | Robinson | 404/29 |
| 1,344,895 | A * | 6/1920 | Irons | 404/34 |
| 1,794,572 | A * | 3/1931 | Wyatt | 52/596 |
| 3,221,614 | A * | 12/1965 | Pertien | 404/41 |
| 5,046,887 | A * | 9/1991 | Fontana et al. | 404/34 |
| 5,054,957 | A * | 10/1991 | Johnson, II | 404/41 |
| 5,251,997 | A * | 10/1993 | Brock | 404/29 |
| 5,281,047 | A * | 1/1994 | Skaug | 404/42 |
| 5,348,417 | A * | 9/1994 | Scheiwiller | 404/41 |
| 5,496,129 | A * | 3/1996 | Dube | 404/29 |
| 5,560,173 | A * | 10/1996 | Scheiwiller | 52/608 |
| 5,702,208 | A * | 12/1997 | Hilfiker et al. | 405/302.4 |
| 5,884,445 | A * | 3/1999 | Woolford | 52/311.2 |
| 6,055,784 | A * | 5/2000 | Geiger | 52/302.1 |
| 6,073,411 | A * | 6/2000 | Ciccarello | 52/589.1 |
| D445,203 | S * | 7/2001 | Abbrancati | D25/113 |
| 6,269,605 | B1 * | 8/2001 | Geiger | 52/608 |
| D447,573 | S * | 9/2001 | Blomquist et al. | D25/113 |
| D488,241 | S * | 4/2004 | Scanni et al. | D25/113 |
| D498,543 | S * | 11/2004 | Schmitz et al. | D25/113 |
| D540,954 | S * | 4/2007 | Bouchard | D25/113 |
| 7,229,235 | B2 * | 6/2007 | Blomquist et al. | 405/284 |
| 7,244,076 | B2 * | 7/2007 | Whitson | 404/73 |
| 7,244,079 | B1 * | 7/2007 | Blomquist et al. | 405/284 |
| 2001/0041092 | A1 * | 11/2001 | Gopfert | 404/41 |
| 2003/0126821 | A1 * | 7/2003 | Scherer et al. | 52/604 |
| 2005/0144883 | A1 * | 7/2005 | Hopson et al. | 52/596 |
| 2007/0166102 | A1 * | 7/2007 | Cornaz | 404/34 |
| 2007/0217865 | A1 * | 9/2007 | Castonguay et al. | 404/41 |
| 2007/0258766 | A1 * | 11/2007 | Mugge | 404/34 |
| 2007/0289247 | A1 * | 12/2007 | Hamel | 52/596 |

* cited by examiner

*Primary Examiner*—Raymond W Addie
(74) *Attorney, Agent, or Firm*—Goudreau Gage Dubuc

(57) ABSTRACT

A paving stone unit and a method for creating paving assemblies therewith, comprising a plurality of regular paving stone units and of notched paving stone units laid one adjacent the other, separated by lines of joint, the notched paving stone units breaking the continuity of the lines of joint, the regular paving stone units and the notched paving stone units being randomly installed from mixed skids thereof, the paving assembly having a randomized layout.

8 Claims, 5 Drawing Sheets

NOTCHED PAVING STONE UNIT AND PAVED ASSEMBLIES FABRICATED THEREWITH

CROSS REFERENCE TO RELATED APPLICATIONS

This application claims priority on U.S. provisional application No. 60/820,273, filed on Jul. 25, 2006. All documents above are herein incorporated by reference.

FIELD OF THE INVENTION

The present invention relates to paving stone units. More specifically, the present invention is concerned with notched paving stone units and paving assemblies fabricated therewith.

BACKGROUND OF THE INVENTION

Paving units used to pave surfaces are available in a number of shapes and sizes, and have been used to lay paving arrangements of a variety of visual appearances.

Lately, a random-type style of paving is much appreciated, wherein the resulting paving shows few continuous lines of joint. However, creating a random-type style paving using standard square or rectangular pavement units, even of different sizes, requires planning ahead the laying thereof, which results cumbersome and time wasting for the pavement workers.

A number of paving units having complex interlocking geometric shapes, such as hexagonal paving units for example, which have appeared on the market, offer means to create such random-type style. However, the resulting paving assemblies still miss the desired random looking visual impact.

There is still a need in the art for paving stone units and random looking paving assembly fabricated therewith.

SUMMARY OF THE INVENTION

More specifically, in accordance with the present invention, there is provided a paving assembly, comprising a plurality of regular paving stone units and of notched paving stone units laid one adjacent the other, separated by lines of joint, the notched paving stone units breaking the continuity of the lines of joint, the regular paving stone units and the notched paving stone units being randomly installed from mixed skids thereof, the paving assembly having a randomized layout.

There is further provided a method for laying a random looking paving assembly, comprising the steps of providing regular paving stone units; providing notched paving stone units; and randomly installing the regular paving stone units and the notched paving stone units; whereby the notched paving stone units have an irregular shape formed by a notch in a regular envelope; said step of installing the notched paving stone units breaking lines of joint formed between regular paving stone units.

There is further provided a notched paving stone unit, having an irregular shaped formed by a notch in a regular envelope, wherein the notched paving stone unit, when introduced in a layout of regular paving stone units, breaks lines of joint formed between said regular paving stone units.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1A:
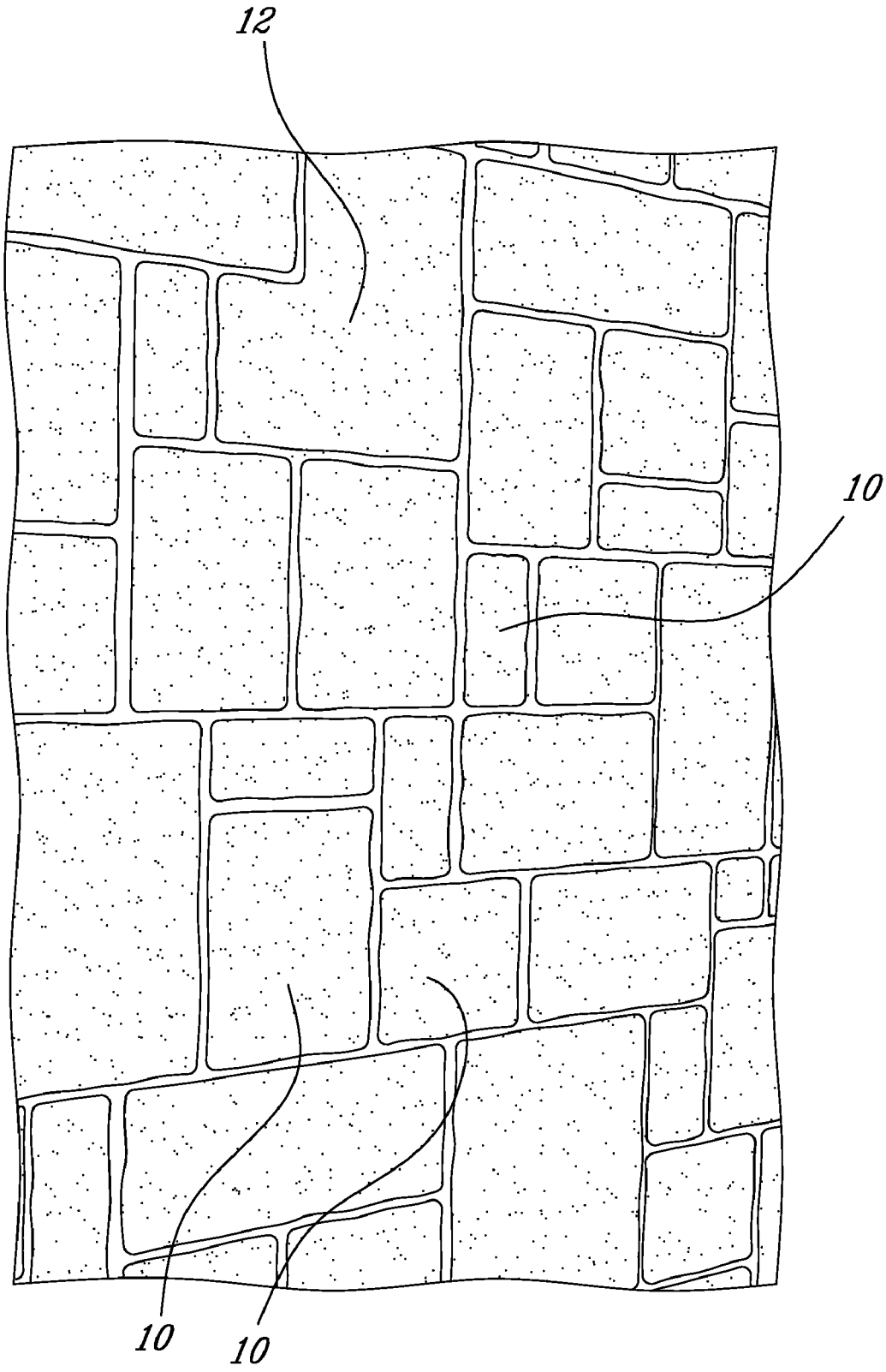
FIGS. 1 are schematical views of paving assemblies according to embodiments of the present invention.
Figure 1B:
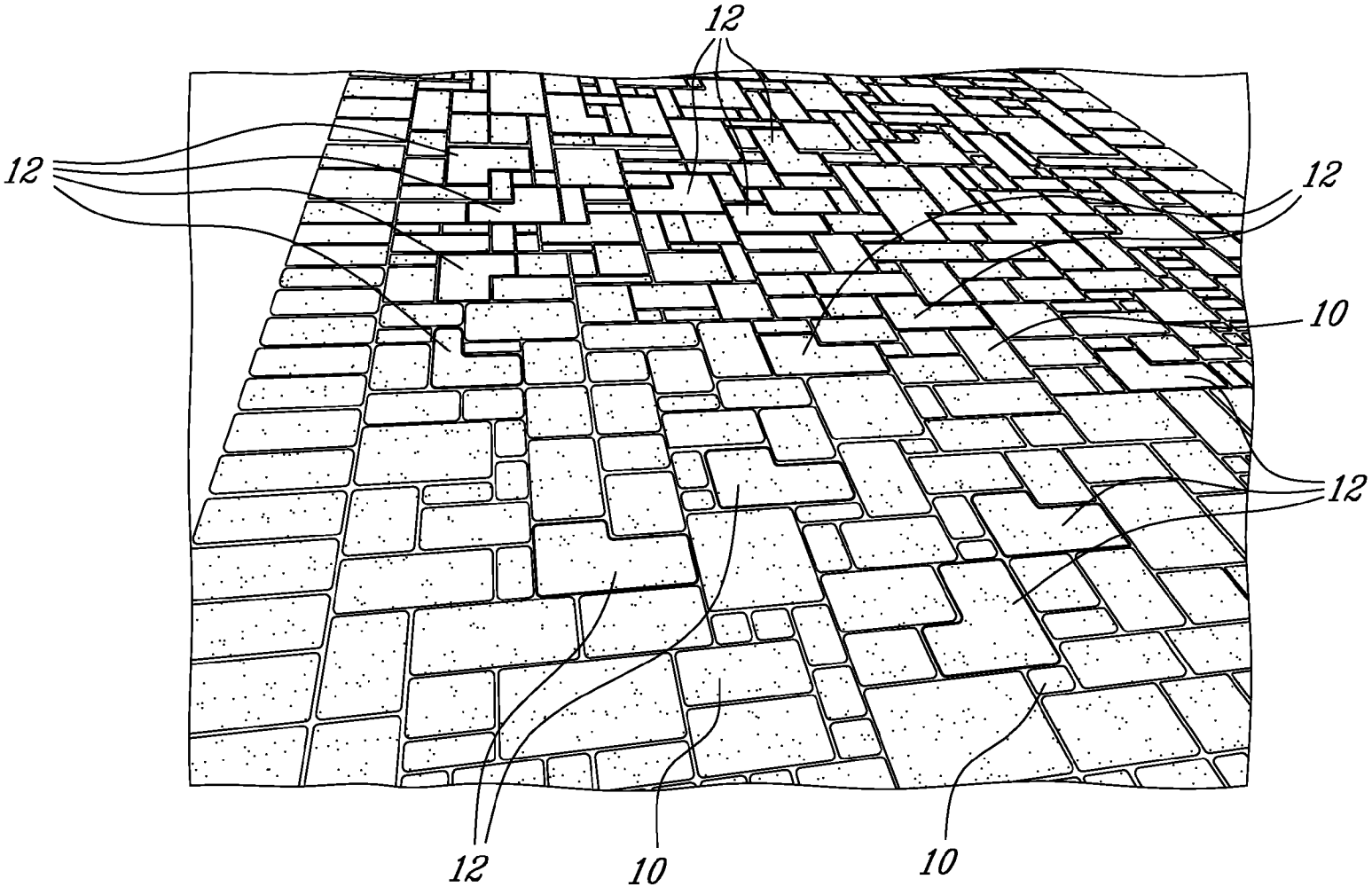
Figure 1C:
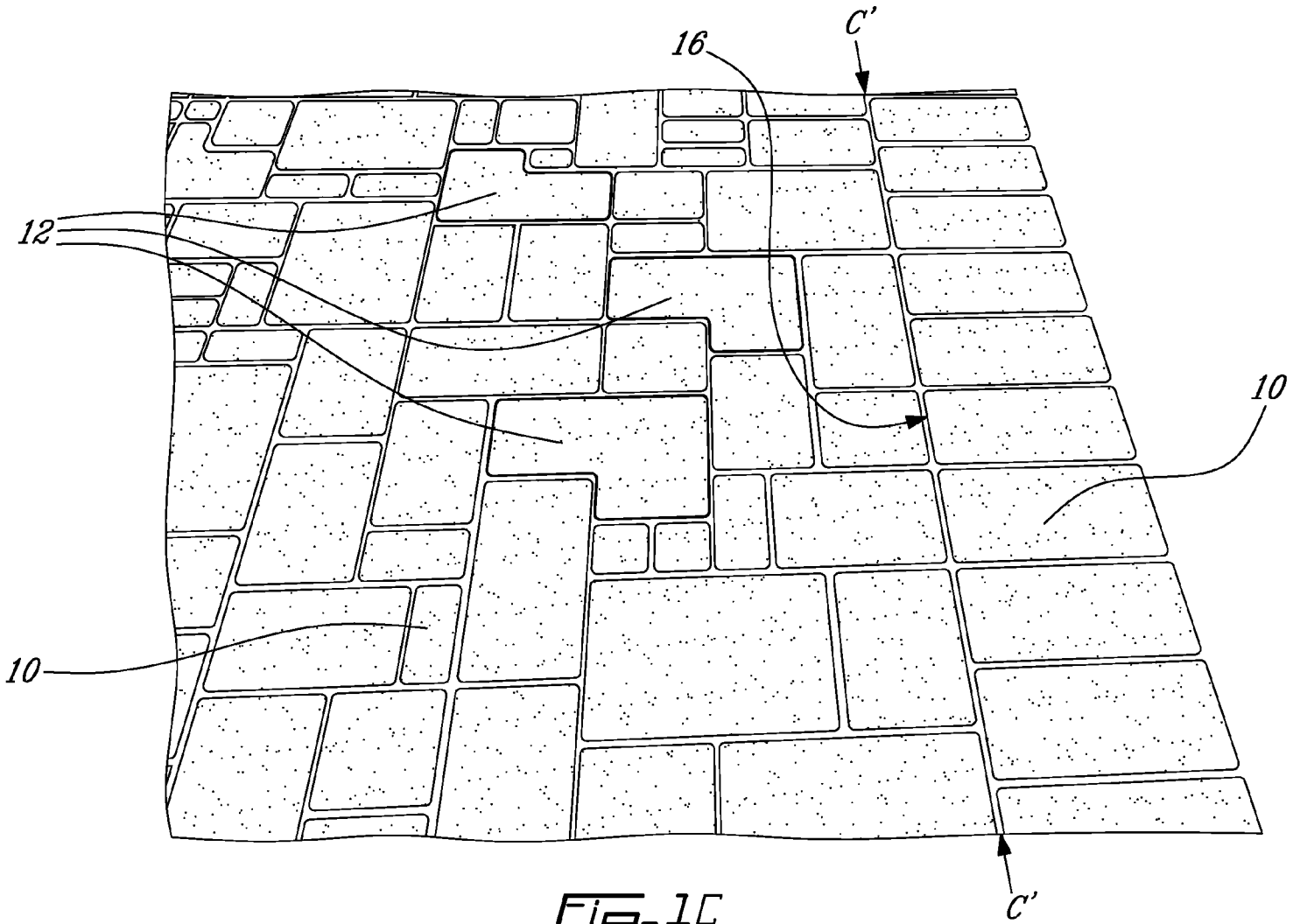
Figure 2:
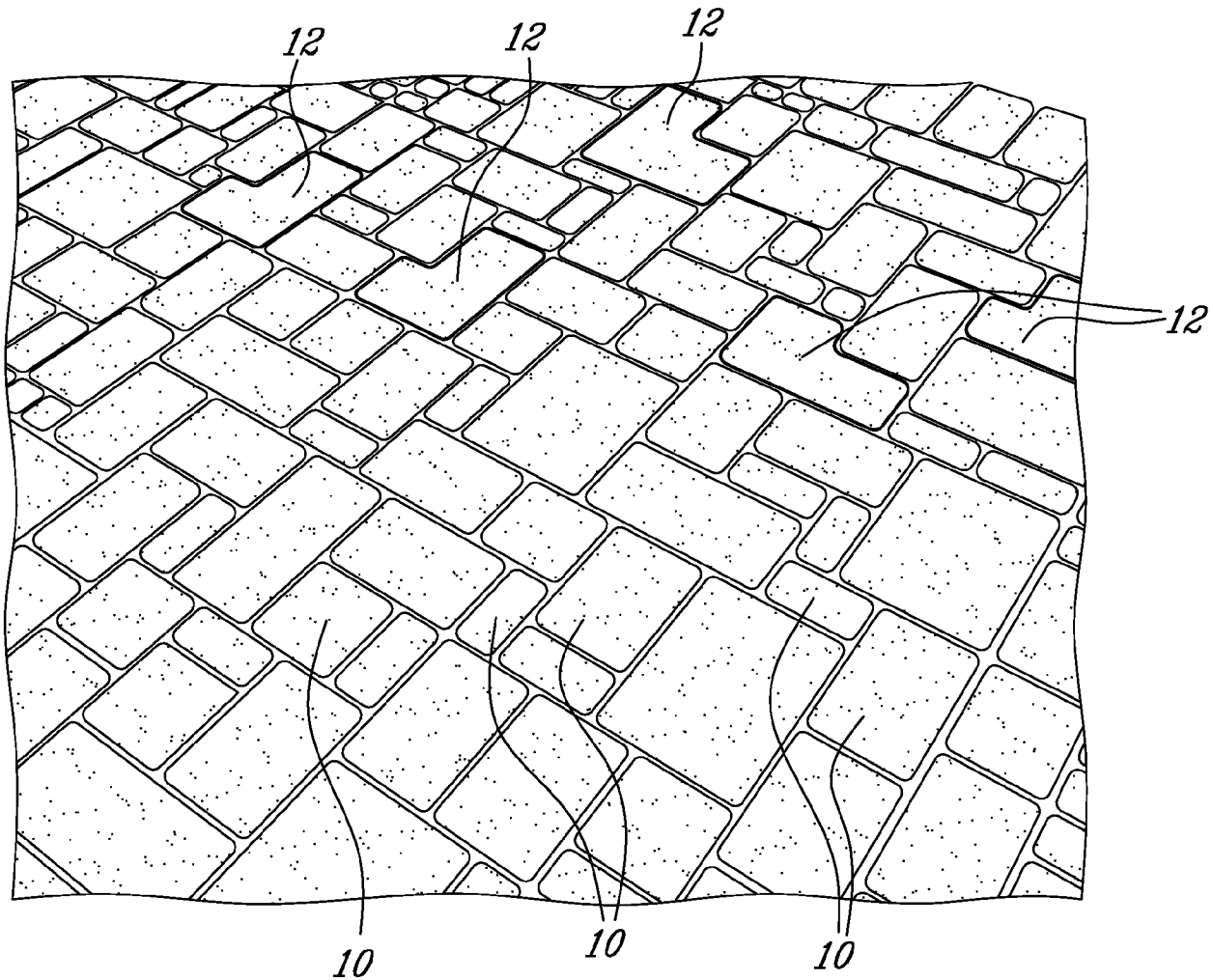
FIG. 2 is a detailed schematical view of a paving assembly according to an embodiment of the present invention.
Figure 3:
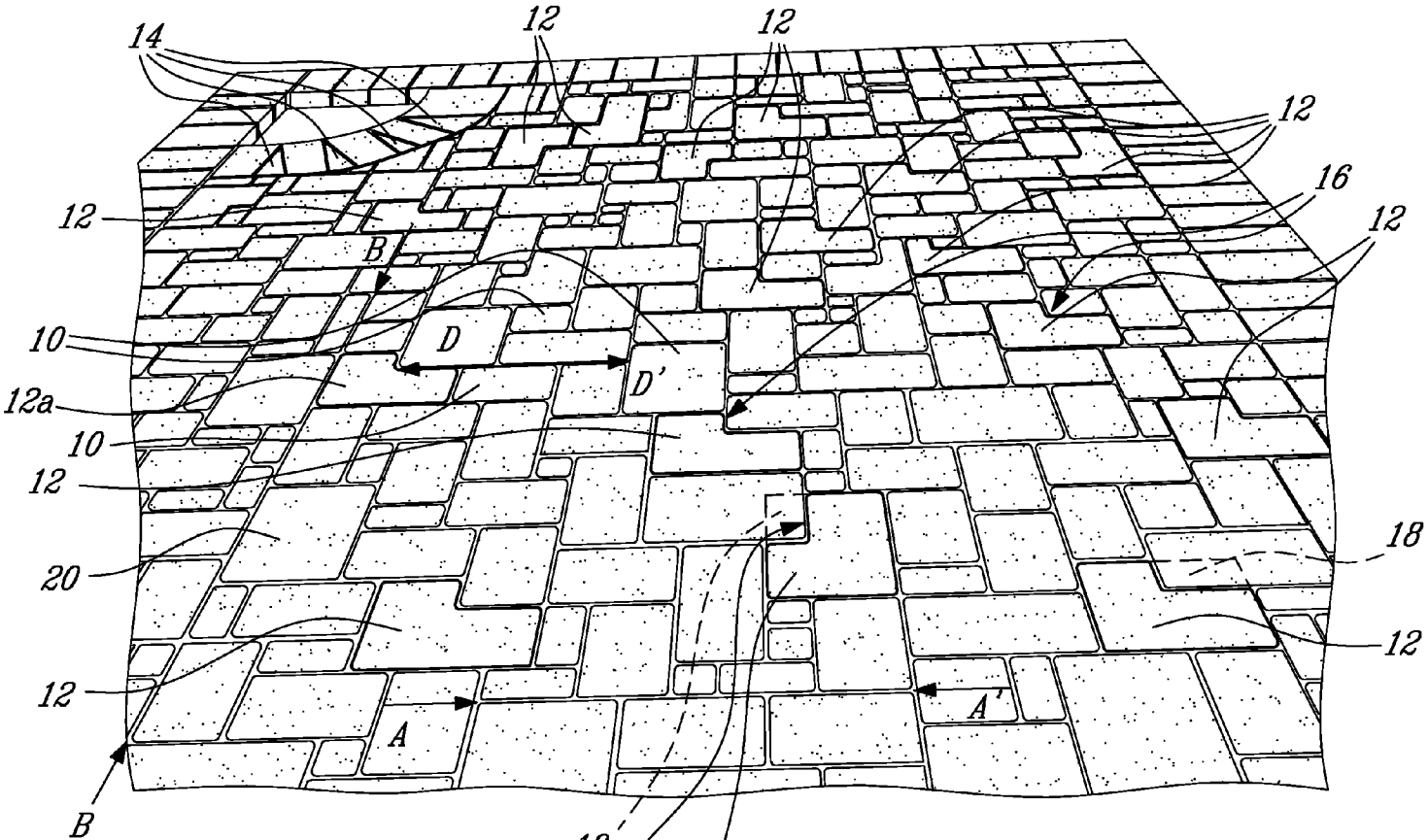
FIG. 3 is a further detailed schematical view of a paving assembly according to an embodiment of the present invention.

A paving assembly as illustrated in FIGS. 1 to 3 comprises a collection of paving stone units 10 and 12.

Paving stone units may be cut during layout of the paving assembly to accommodate curves for example, as shown in 14 (see FIG. 3).

Generally, paving stone units as shown in 10, have regular shapes, i.e. rectangular or quasi-square shapes, in a variety of sizes. They are laid one adjacent the other, separated by a line of joint.

Selecting paving stone units 10 of different sizes and making sides of different lengths face together allow forming varied paving assemblies. However, even though varied, such assemblies of paving stone units 10 are still characterized by lengths of continuous joints, as shown between arrows C and C' in FIG. 1*c* for example.

Indeed, only a limited random style look may be achieved using paving stone units 10 of different sizes and making sides of different lengths face together, and only by lengthy and cumbersome planning ahead of the laying of the paving stone units 10.

Paving stone units 12 have a generally irregular shape: their envelope 18 (shown in dash lines in FIG. 3) is a rectangle or a square for example, and they are provided with a notch 16 breaking the regularity of this envelope.

Such paving stone units 12 allow laying an irregular design. Moreover, such paving stone units 12 allow extra breaking of joint (see joints D-D' and A-A, compared to joint B-B' in FIG. 3).

Introducing a paving stone unit 12*a* in a layout of regular-shaped paving stone units 10 automatically breaks lines of joint (see paving stone 12*a* breaking joint line D-D' in FIG. 3). Each paving stone 12 modifies a current alignment of joints.

No planning ahead is needed. A paving worker only needs to randomly lay paving stone units from different stacks of paving stone units 10, of different sizes for example, and of paving stone units 12. For example, a ready for use skid may comprise, for a surface of paving assembly of 9.75 $m^2$ for instance, a number of standard paving stone units 10 (small rectangles 150×76 mm; squares 150×150 mm; medium rectangles 150×225 mm; medium rectangles 150×300 mm; large rectangles 225×300 mm) and a number of notched paving stone units 12.

The paving stone units 12 may come in a range of sizes too, with notches of different sizes in a generally lengthwise direction or widthwise direction. Their use provides randomizing the layout of the paving assembly, by multiplying the breaking of lines of joint.

As known in the art, the underlying ground is first prepared. The paving stone units 10, 12 are then installed from skids thereof, working vertically down the rows. Sand is then spread and swept over the top of the paving stone units and a compactor is used as known in the art.

As shown in the Figures, the resulting paving assembly has an improved random looking style.

The paving stone units 10 and 12 may be made in a concrete material or natural stone for example, in a mild, as known in the art. Their surfaces is generally flat, either smooth or tumbled.

Although the present invention has been described hereinabove by way of specific embodiments thereof, it can be modified, without departing from the spirit and nature of the subject invention as defined in the appended claims.

What is claimed is:

1. A paving assembly, comprising:

first paving stone units having a shape selected in the group consisting of squares and rectangles; and second paving stone units having a shape with an envelope selected in the group consisting of squares and rectangles, with a notch cut out from said envelope at right angles; wherein said second paving stone units have notches of different sizes in one of a generally lengthwise direction and a generally widthwise direction;

said first and second paving stone units being laid with sides thereof adjacent one another and with a bottom surface thereof on an underlying surface, separated by lines of joint, to completely cover the underlying surface except at said lines of joint, said notches of said second paving stone units breaking the continuity of said lines of joint, said first paving stone units and said second paving stone units being randomly installed from mixed skids thereof, said paving assembly having a randomized layout.

2. The paving assembly of claim 1, wherein said first paving stone units have shapes selected in the group consisting of rectangles and squares of a variety of sizes.

3. The paving assembly of claim 1, wherein said first paving stone units are laid with sides thereof of different lengths facing each other.

4. The paving assembly of claim 1, wherein said first paving stone units and said second paving stone units have generally flat top surfaces.

5. The paving assembly of claim 4, wherein said top surfaces are one of: i) smooth and ii) tumbled.

6. The paving assembly of claim 1, wherein each second paving stone unit modifies a current alignment of joints.

7. The paving assembly of claim 1, wherein each mixed skid comprises first paving stone units having a rectangular shape of at least one size; first paving stone units having a square shape of at least one size; and second paving stone units of at least one size.

8. The paving assembly of claim 1, wherein said first paving stone units and said second paving stone units are made in one of: i) concrete material and ii) natural stone.

* * * * *